United States Patent [19]

Lai

[11] Patent Number: 4,595,526

[45] Date of Patent: Jun. 17, 1986

[54] HIGH FOAMING NONIONIC SURFACANT BASED LIQUID DETERGENT

[75] Inventor: Kuo-Yann Lai, Plainsboro, N.J.

[73] Assignee: Colgate-Palmolive Company, New York, N.Y.

[21] Appl. No.: 656,103

[22] Filed: Sep. 28, 1984

[51] Int. Cl.[4] ..... C11D 1/831; C11D 1/84

[52] U.S. Cl. ..... 252/545; 252/546; 252/547; 252/548; 252/550; 252/554; 252/555; 252/557; 252/558; 252/559; 252/DIG. 14

[58] Field of Search ..... 252/545, 546, 547, 548, 252/DIG. 14, DIG. 13, 550, 554, 558, 557, 559, 555

[56]. References Cited

U.S. PATENT DOCUMENTS

| | | | |
|---|---|---|---|
| 3,849,348 | 11/1974 | Hewitt | 252/547 |
| 3,950,417 | 4/1976 | Verdicchio et al. | 252/545 |
| 3,962,418 | 6/1976 | Birkofer | 424/70 |
| 3,970,596 | 7/1976 | Klisch et al. | 252/546 |
| 4,064,076 | 12/1977 | Klisch et al. | 252/542 |
| 4,102,825 | 7/1978 | Murata et al. | 252/547 |
| 4,247,425 | 1/1981 | Egan et al. | 252/548 |
| 4,329,334 | 5/1982 | Su | 424/70 |
| 4,450,091 | 5/1984 | Schmolka | 252/174.21 |
| 4,486,328 | 12/1984 | Knott et al. | 252/117 |

FOREIGN PATENT DOCUMENTS

| | | |
|---|---|---|
| 1277495 | 9/1968 | Fed. Rep. of Germany . |
| 2612095 | 10/1976 | Fed. Rep. of Germany . |
| 76106 | 11/1973 | Japan . |
| 38508 | 3/1977 | Japan . |
| 195800 | 12/1982 | Japan . |

*Primary Examiner*—Prince E. Willis

*Attorney, Agent, or Firm*—Herbert S. Sylvester; Murray M. Grill; Richard N. Miller

[57] ABSTRACT

A high foaming, nonionic surfactant based, light duty, liquid detergent with desirable cleansing properties and mildness to the human skin comprising four essential surfactants:

1. a water soluble nonionic surfactant as the major active ingredient, in an amount in excess of 50% by weight of the total surfactant content;
2. a supplemental amount of a water soluble, foaming, anionic surfactant excluding the ethoxylated alkyl ether sulfates;
3. a lesser amount of a water soluble, foaming zwitterionic betaine surfactant; and
4. a minor amount of a fatty acid alkanolamide foam stabilizer; dissolved in an aqueous vehicle.

9 Claims, No Drawings

HIGH FOAMING NONIONIC SURFACANT BASED LIQUID DETERGENT

BACKGROUND OF THE INVENTION

The present invention relates to novel light duty liquid detergent compositions with high foaming properties, containing a nonionic surfactant as the major active ingredient supplemented with lesser amounts of a specific group of anionic surfactants and even smaller amounts of a zwitterionic betaine surfactant and a fatty acid alkanolamide foam stabilizer in an aqueous medium.

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the application of nonionic surfactants is limited. There have been substantial interest and efforts to develop a high foaming detergent with nonionic surfactants as the major ingredient. Yet, little has been achieved.

The prior art is replete with light duty liquid detergent compositions containing nonionic surfactants in combination with anionic and/or zwitterionic betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient. The specific class of anionics utilized in this patent is the very same group of anionic detergents expressly excluded in present invention in order to eliminate the alkanol ethoxylate sulfation process and the potential dioxane toxicity problem. Furthermore, this patent finds heavily foaming detergents undesirable for the purpose of washing socks. Still further, this patent detergent composition lacks a fatty acid alkanoleamide foam stabilizer which is an essential ingredient in present light duty liquid detergent.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

However, none of the above-cited patents discloses a high foaming, nonionic based, liquid detergent composition containing a nonionic surfactant as the major active ingredient and minor amounts of a supplementary high foaming anionic sulfate or sulfonate surfactant excluding ethoxylated alcohol ether sulfates, a supplementary foaming zwitterionic surfactant selected from the betaine group and a fatty acid alkanolamide foam stabilizer, as the four essential ingredients, said nonionic ingredient constituting more than 50% of the total surfactant content.

SUMMARY OF THE INVENTION

It has now been found that a high foaming liquid detergent can be formlated with a nonionic surfactant as the major active ingredient which has desirable cleaning properties, mildness to the human skin and avoids the dioxane toxicity problem associated with the sulfation process of manufacturing anionic ethoxylated alcohol ether sulfates.

Accordingly, one object of the invention is to provide novel, high foaming, nonionic based, light duty liquid detergent compositions containing a ing 50% of the total surfactant content.

Another object of this invention is to provide novel, nonionic based, iquid detergent compositions containing a major amount of nonionic surfactant supplemented with lesser amounts of an anionic surfactant, a zwitterionic betaine surfactant and a fatty acid alkanolamide foam stabilizer.

Still another object of this invention is to provide a novel, nonionic based, liquid detergent with desirable high foaming and cleaning properties which is mild to the human skin.

A further object of this invention is to provide a novel, nonionic based liquid detergent containing a supplemental anionic surfactant excluding the ethoxylated alkyl ether sulfates which eliminates the alkanol ethoxylate sulfation process and the potential dioxane toxicity problem.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the novel, high foaming, nonionic based, light duty liquid detergent of this invention comprises four essential surfactants: a water soluble, ethoxylated, nonionic surfactant as the major active ingredient in an amount exceeding 50% by weight of the total surfactant content; a supplemental amount of a foaming anionic surfactant selected from the group consisting of water soluble organic sulfates and organic sulfonates, excluding the ethoxylated alkyl ether sulfates; a lesser amount of a foaming, water soluble, zwitterionic surfactant selected from the class of betaines; and a minor amount of an alkanolamide, dissolved in an aqueous vehicle.

More specifically, the present invention relates to a high foaming, nonionic based, liquid detergent containing more than 50% by weight of the total surfactant content of a nonionic surfactant selected from the group consisting of water soluble primary aliphatic alcohol ethoxylates, secondary aliphatic alcohol ethoxylates, alkyl phenol ethoxylates and alcohol ethylene oxide-propylene oxide condensates; and supplementary amounts of an anionic surfactant selected from the group consisting of water soluble salts of $C_8$–$C_{18}$ alkyl sulfates, $C_8$–$C_{16}$ benzene sulfonates, $C_{10}$–$C_{20}$ paraffin sulfonates, alpha $C_{10}$–$C_{24}$ olefin sulfonates, $C_8$–$C_{18}$ alkyl sulfoacetates, $C_8$–$C_{18}$ alkyl sulfosuccinate esters, $C_8$–$C_{18}$ acyl isethionates and $C_8$–$C_{18}$ acyl taurates; of a water soluble zwitterionic betaine surfactant; and of a fatty acid alkanolamide; the total content of said supplementary surfactants constituting less than 50% by weight of the total surfactant content, dissolved in an aqueous vehicle.

This particular combination of four ingredients in the proportions, by weight, of more than 50% nonionic surfactant to less than 50% of the sum of anionic surfactant, betaine and fatty acid alkanolamide, is critical to the high foaming and desirable cleansing properties of present liquid detergent and the retention of the mildness to the skin property. The total amount of surfactants may constitute about 10%–55%, preferably about 20%–40%, most preferably 25%–35%, by weight of the liquid composition.

DETAILED DESCRIPTION OF THE INVENTION

The omission of one or more ingredients adversely affects foaming as shown in Tables 1 and 2 using the well known Ross-Miles foam test described in "Oil and Soap," 18, Pages 99–102, (1941). 0.1% test solutions of detergent compositions are run in a Ross-Miles foam column, and the foam height is recorded.

TABLE 1

Foam Generation (room temperature approx. 20° C.)

| Detergent Composition | Foam Height (mm) 0 ppm | Tap Water (@ 100 ppm) | 300 ppm |
|---|---|---|---|
| N91-8[1] (30% AI) | 60 | 68 | 60 |
| 16/6 | 112 | 110 | 105 |
| N91-8/ALS[2] 16/6/4 | 140 | 143 | 120 |
| N91-8/ALS/Betaine[3] 16/6/4/3 | 143 | 152 | 142 |
| N91-8/ALS/Betaine/LMMEA[4] Leading Brand of Commercial LDLD[5] | 122 | 146 | 103 |

[1]Neodol ethoxylate (Shell Co.) containing 8 ethylene oxide groups per mole of $C_9$–$C_{11}$ aliphatic alcohol
[2]Ammonium lauryl sulfate (65% $C_{12}$ alkyl, 28% $C_{14}$ alkyl and 7% $C_{16}$ alkyl by weight)
[3]Cocoamidopropyl dimethyl betaine
[4]Lauryl myristyl monoethanolamide
[5]Containing 30% by weight of anionic surfactants and 4% by weight of fatty acid alkanolamide

TABLE 2

Foam Generation (50° C.)

| Detergent Composition | Foam Height (mm) 0 ppm | Tap Water (@ 100 ppm) | 300 ppm |
|---|---|---|---|
| N91-8 (30% AI) | 75 | 95 | 70 |
| 16/6 | 126 | 132 | 125 |
| N91-8/ALS 16/6/4 | 134 | 145 | 141 |
| N91-8/ALS/Betaine 16/6/4/3 | 163 | 170 | 148 |
| N91-8/ALS/Betaine/LMMEA Leading Brand of Commercial LDLD[5] | 149 | 174 | 135 |

These results clearly show that the omission of one or more of the ingredients from the nonionic based detergent composition of present invention greatly reduces the foaming and fails to afford satisfactory foaming. It is also noted that the present compositions exhibit better foaming than a light duty liquid detergent presently on the market which contains about 30% by weight of a mixture of anionic alkyl benzene sulfonate and anionic alkyl polyethenoxy ether sulfate detergents and about 4% by weight of a fatty acid alkanolamide.

The nonionic surfactant which constitutes the major ingredient in present liquid detergent is present in amounts of about 8%–30%, preferably 13%–25%, most preferably 16%–22%, by weight of the composition and provides superior performance in the removal of oily soil and mildness to human skin.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such as Plurafacs (Wyandotte) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration ) condensed with about 5 to 30 moles of ethylene oxide, for example, lauryl-myristyl alcohol condensed with about 16 moles of ethylene oxide (EO), tridecanol condensed with about 6 moles of EO, myristyl alcohol condensed with about 10 moles of EO per mole of myristyl alcohol, the condensation product of EO with a heart-cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol ethoxylates having about 5 to 20 ethyleneoxy groups per mole of aliphatic primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8–15 and give good O/W emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of EO per mole of nonyl phenol, dodecyl phenol condensed with about 12 moles of EO per mole of phenol, dinoyl phenol condensed with about 15 moles of EO per mole of phenol and di-isooctylphenol condensed with about 15 moles of EO per mole of phenol. Commercially available nonionic surfactants of this type include Igepal CO-630 (nonyl phenol ethoxylate) marketed by the GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propyloxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having an HLB of 8 to 15 also may be employed as the nonionic detergent ingredient in the described shampoo. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic detergents which are less perferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000, and the polyethylene oxide content may comprise 20% to 80% by weight. Preferably, these surfactants will be in liquid form and satisfactory surfactants are available as grades L 62 and L 64.

The anionic surfactant, which is an essential ingredient of present liquid detergent composition, constitutes about 1% to 10%, preferably 2%–8%, most preferably 3%–6%, by weight thereof and provides good foaming properties. However, preferably reduced amounts are utilized in order to enhance the mildness to the skin property desired in the inventive compositions, and thus, the weight ratio of nonionic detergent to anionic should exceed about 3:1. In addition, the particular group of anionic surfactants utilized excludes the $C_8$–$C_{18}$ alkyl polyethenoxy ether sulfate surfactants in order to avoid the dioxane toxicity associated with the process of sulfation of ethoxylated alcohols. Thus, said ethoxylated alcohol ether sulfates are expressly excluded from the specific group of anionic surfactants utilized.

The anionic surfactants which may be used in the nonionic based liquid detergent of this invention are water soluble and include the sodium, potassium, ammonium and ethanolammonium salts of $C_8$–$C_{18}$ alkyl sulfates such as lauryl sulfate, myristyl sulfate and the like; linear $C_8$–$C_{16}$ alkyl benzene sulfonates; $C_{10}$–$C_{20}$ paraffin sulfonates; alpha olefin sulfonates containing about 10–24 carbon atoms; $C_8$–$C_{18}$ alkyl sulfoacetates; $C_8$–$C_{18}$alkyl sulfosuccinate esters; $C_8$–$C_{18}$ acyl isethionates; and $C_8$–$C_{18}$ acyl taurates. Preferred anionic surfactants are the water soluble $C_{12}$–$C_{16}$ alkyl sulfates, the $C_{10}$–$C_{15}$ alkylbenzene sulfonates, the $C_{13}$–$C_{17}$ paraffin sulfonates and the alpha $C_{12}$–$C_{18}$ olefin sulfonates.

The water-soluble zwitterionic surfactant, which is also an essential ingredient of present liquid detergent composition, constitutes about 0.5–8%, preferably 2%–6%, most preferably 3%–5%, by weight and provides good foaming properties and mildness to the present nonionic based liquid detergent. The zwitterionic surfactant is a water soluble betaine having the general formula:

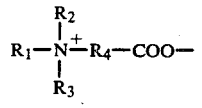

wherein $R_1$ is an alkyl group having 10 to about 20 carbon atoms, preferably 12 to 16 carbon atoms, or the amido radical:

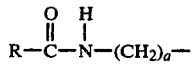

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethylammonio) acetate, coco dimethyl betaine or 2-(N-coco-N, N-dimethylammonio) acetate, myristyl dimethyl betaine, palmityl dimethyl betaine, lauryl diemthyl betaine, cetyl dimethyl betaine, stearyl dimethyl betaine, etc. The amidobetaines similarly include cocoamidoethyl betaine, cocoamidopropyl betaine and the like. A preferred betaine is coco ($C_8$–$C_{18}$) amidopropyl dimethyl betaine.

The fourth essential ingredient of the present nonionic based liquid detergent is a fatty acid $C_2$–$C_3$ alkanolamide which functions as a foam stabilizer in amounts of about 0.5–8%, preferably 2%–6%, most preferably 3%–5%, by weight of the composition. Useful compounds in this group include mono- and diethanolamides and isopropanolamides of higher fatty acids having about 10–18 carbon atoms. Specific examples of suitable alkanolamides include cocomonoethanolamide, cocodiethanolamide, lauric-myristic diethanolamide, lauric monoethanolamide, lauric monoisopropanolamide and lauric-myristic monoethanolamide, with the latter being particularly preferred.

All of the aforesaid four ingredients in this light duty liquid detergent are water soluble or water dispersible and remain so during storage.

This particular combination of anionic surfactant and betaine surfactant, together with the fatty acid alkanolamide foam stabilizer, provides a detergent system which coacts with the nonionic surfactant to produce a liquid detergent composition with desirable foaming, foam stability, detersive properties and mildness to human skin. Surprisingly, the resultant homogeneous liquid detergent exhibits the same or better foam performance, both as to initial foam volume and stability of foam in the presence of soils, and cleaning efficacy as an anionic based light duty liquid detergent (LDLD) as shown in the following Table 3 based upon the Hand Dishwashing test. In this test, ceramic dinner plates having a diameter of nine and one-half inches soiled with about 4 grams of Crisco® or about 15 grams of Ragu® spaghetti sauce soil are washed at thirty second intervals in a dish pan containing either six grams (0.1%) or 12 grams (0.2%) of liquid composition dissolved in six liters of water of a selected hardness at a temperature of about 46° C. (Six grams of detergent are employed when each plate is soiled with Ragu® spaghetti sauce and twelve grams are employed when each plate is soiled with Crisco® at the beginning of the test). A layer of foam is generated by allowing the six liters of water to fall from a separatory funnel mounted sixteen inches above the bottom of the dishpan into a Petri dish containing the liquid composition to be tested which is located in the center of the dish pan. The Petri dish is removed carefully and the foam height is measured prior to the start of the test. A soiled dish is placed in the solution every thirty seconds and is washed by the operator for 10 to 15 seconds while holding it about half in and half out of the solution. Washing continues until about one half of the surface of the dish pan is covered with foam. Usually, a control is run at the same time as the test product in order to eliminate any differences due to different operators. Results are reproducible and a difference of the two plates is considered to be significant.

TABLE 3

Performance Evaluation of Various Nonionic Surfactants

| | Hand Dishwashing Performance (No. of plates washed) | |
|---|---|---|
| | Crisco | Ragu Sauce |
| Nonionic Based System 19/6/4/5 X/ALS/Betaine/LMMEA | | |
| X = Neodol 91-8 | 20 | 41 |
| X = Neodol 91-6 | 20 | 38 |
| X = Neodol 23-6.5 | 17 | 32 |
| X = Neodol 25-12 | 17 | 34 |
| X = Neodol 45-11 | 15 | 32 |
| X = Tergitol 15-S-9 | 16 | 33 |
| X = Tergitol 15-S-12 | 16 | 32 |
| X = Igepal CO-630[6] | 18 | 37 |
| X = Plurafac B-26[7] | 17 | 31 |
| X = Ultrawet N[8] | 19 | 38 |
| Anionic Based System | | |
| 17/13/4 LDBS[9]/AEOS(3)[10]/LMMEA | 15 | 34 |
| 16/6/4/3 AEOS (6.5)/ALS/Betaine/LMMEA | 17 | 33 |

Neodol (Shell): Primary alcohol ethoxylates
Tergitol (Union Carbide): Secondary alcohol ethoxylates
[6]Ethoxylated (9.5) nonylphenol
[7]Condensate of ethylene oxide and propylene oxide on $C_{10}$–$C_{16}$ alkanol (EO/PrO = 3:1 and total alkylene oxide = 75%)
[8]Modified alkanol ethoxylate
[9]Sodium linear dodecyl benzene sulfonate
[10]Ammonium $C_{12}$–$C_{15}$ alkyl $(C_2H_4O)_3$ sulfate Neodol (Shell): Primary alcohol ethoxylates Tergitol (Union Carbide): Secondary alcohol ethoxylates 6- Ethoxylated (9.5) nonylphenol 7- Condensate of ethylene oxide and propylene oxide on $C_{10}$–$C_{16}$ alkanol (EO/PrO=3:1 and total alkylene oxide=75%) 8- Modified alkanol ethoxylate 9- Sodium linear dodecyl benzene sulfonate 10- Ammonium $C_{12}$–$C_{15}$ alkyl $(C_2H_4O)_3$ sulfate The performance results with the hand dishwashing evaluation summarized in Table 3 clearly show that the nonionic surfactant-based formulations perform equivalent to or better than the anionic based systems.

It has been found that satisfactory performance can also be achieved with the present nonionic based liquid detergent at reduced levels of anionic surfactant in order to obtain better mildness; and at lower levels of ethanolamides in order to avoid clouding of the composition, as shown in Table 4.

TABLE 4

| Examples | Hand Dishwashing Performance (No. of plates washed) | |
|---|---|---|
| | Crisco | Ragu Sauce |
| 1. 19/6/4/5 | 20 | 41 |

TABLE 4-continued

| Examples | Hand Dishwashing Performance (No. of plates washed) Crisco | Ragu Sauce |
|---|---|---|
| Neodol 91-8/ALS/Betaine/LMMEA 2. 19/4/4/5 | 17 | 37 |
| Neodol 91-8/ALS/Betaine/LMMEA 3. 19/2/4/5 | 17 | 32 |
| Neodol 91-8/ALS/Betaine/LMMEA 4. 19/6/4/4 | 17 | 36 |
| Neodol 91-8/ALS/Betaine/LMMEA 5. 19/6/4/3 | 16 | 32 |
| Neodol 91-8/ALS/Betaine/LMMEA 6. 34 Neodol 91-8 | 3 | 7 |

Amounts as low as 2% anionic surfactant (Example 3), exhibit good performance and amounts as low as 3% ethanolamide (Example 5) exhibit good performance, particularly as compared with a composition containing 34% by weight of Neodol 91-8 nonionic detergent.

The nonionic surfactant-based formulation offers the following benefits in addition to similar or better performance:

Eliminates the potential dioxane toxicity problem associated with manufacture of alkanol ethoxamer-sulfates Leaves more possibilities for further improvement in mildness Leaves more room for cost-saving Soil removal performance, as an evaluation of cleaning efficiency for dishwashing or general application, is superior to known products presently on the market as shown in Table 5, using a static soaking test. A soil-containing plate (0.5 g of Crisco® soil) which has been aged for 1½ min. is soaked for 30 sec. in a warm (50° C.) aqueous test solution of 150 ppm hardness and 100 ppm alkalinity which contains 0.1% detergent and is immediately transferred to an ice-water bath to stop the soil removing process. The unremoved soil is solidified on the plate which is air dried and % SR (Soil Removal) is calculated $$\% SR = \frac{\text{Amount of Soil Removed}}{\text{Original Amount of Soil}} \times 100\%$$

TABLE 5

| Detergent | Static Soak Test % of Soil Removal |
|---|---|
| 1. Commercial LDLD Leading Brand A[a] | 33 |
| 2. Commercial LDLD Leading Brand B[b] | 54 |
| 3. Neodol 91-8 (30% AI) | 2.5 |
| 4. Neodol 23-6.5 (30% AI) | 19 |
| 5. 16/6/4/3 N 91-8/ALS/BE[c]/LMMEA | 73 |
| 6. 16/6/4/3 N 91-8/ALS/BE[c]/LMDEA | 56 |
| 7. 16/10/3 N 91-8/AEOS(3)/LMMEA | 50 |

[a]Contains 17% of sodium dodecylbenzene sulfonate, 13% of ammonium $C_{12}$–$C_{15}$ alkyl triethenoxy ether sulfate and 4% of fatty acid alkanolamide.
[b]Contains approximately 15% of $C_{12}$–$C_{14}$ polyethenoxy (12) ether sulfate, 8% of $C_{12}$–$C_{14}$ ethenoxy (1) ether sulfate, 3% ammonium lauryl sulfate, 5% lauryl dimethyl amine oxide, 1% alkyl glyceryl ether sulfonate and 1% of nonionic.
[c]BE - $C_8$–$C_{18}$ alkylamidopropyl dimethyl betaine (a) Contains 17% of sodium dodecylbenzene sulfonate 13% of ammonium $C_{12}$–$C_{15}$ alkyl triethenoxy ether sulfate and 4% of fatty acid alkanolamide. (b) Contains approximately 15% of $C_{12}$–$C_{14}$ polyethenoxy (12) ether sulfate, 8% of $C_{12}$–$C_{14}$ ethenoxy (1) ether sulfate, 3% ammonium lauryl sulfate, 5% lauryl dimethyl amine oxide, 1% alkyl glyceryl ether sulfonate and 1% of nonionic. (c) BE - $C_8$–$C_{18}$ alkylamidopropyl dimethyl betaine.

It is also noted that comparative Example 7 which contains ethoxylated alkyl ether sulfates exhibits poorer soil removal results than Examples 5 and 6 which are representative of the present invention.

The present invention is also suitable for laundry application when high foaming is desirable such as in the case of hand washing.

Oily soil detergency performance, as an evaluation of comparative cleaning efficiency for laundry application, is shown in Table 6. A number of dacron/cotton swatches of 65/35 fabric content are soiled with 3 drops of the following soils on separate swatches and labeled accordingly:

1. O/T/E—oleic acid/Triolene/Eicogene
2. DMO—dirty motor oil
3. Sebum—Spanglers sebum
4. Nujol—Mineral oil.

The swatches are washed in a tergotometer bucket, containing 0.96 gms detergent per liter tap water at room temperature, for ten minutes. The swatches are removed from the bucket and rinsed with cold water, dried in a dryer, and the reflectance, Rd, of each swatch is read, using a Macbeth or Radio Shack computer. The higher Rd value indicates better detergency and generally a difference of about 2 rd units is significant because it can be perceived by the eye.

TABLE 6

| Detergent | Oil Soil Detergency Rd Sebum | DMO | O/T/E | Nujol |
|---|---|---|---|---|
| 1. Typical Laundry Liquid Brand A 32/7 N25-7[11]/LDBS[12] | 76.1 | 41.1 | 61.6 | 69.2 |
| 2. Typical Laundry Liquid Brand B 18/16/1 AEOS (2)/LDBS/CDEA[13] | 73.7 | 43.5 | 62.0 | 67.6 |
| 3. 16/6/4/3 N23-6.5/ALS/BE/LMMEA | 73.3 | 40.03 | 65.7 | 70.0 |
| 4. 16/6/4/3 N91-8/ALS/BE/LMMEA | 74.4 | 41.4 | 65.4 | 70.0 |
| 5. 16/10/3 N91-8/LDBS/LMMEA | 72.5 | 42.3 | 62.0 | 67.9 |
| 6. 16/10/3 N91-8/LTBS/LMMEA | 72.2 | 43.7 | 62.0 | 68.4 |
| 7. 16/6/4/3 N91-8/ALS/BE/LMDEA | 72.7 | 39.3 | 64.7 | 68.3 |
| 8. 16/10/3 N91-8/AEOS(3)/LMMEA | 71.8 | 38.8 | 61.1 | 68.2 |

[11]Neodol ethoxylate containing 7 ethylene oxide groups per mole of $C_{12}$–$C_{15}$ aliphatic alcohol
[12]Linear sodium dodecyl benzene sulfate
[13]Cocodiethanolamide This table clearly shows the superior detergency of Examples 3, 4, and 7 representing the present invention against O/T/E and Nujol soil, as well as the comparable detergency against Sebum and DMO soils despite a lesser total active detergent concentration than commercially available detergents (i.e., 29% in Examples 3, 4 and 7 vs. 39% and 33% in Examples 1 and 2). It is also noted that the omission of the betaine from present novel compositions (Examples 5 and 6) gives poorer detergency results with reference to Sebum, O/T/E and Nujol soils. The use of the ethoxylated ether sulfates which are excluded from the group of anionic surfactants utilized in present invention yield poorer detergent compositions than the present compositions.

The four essential ingredients discussed above are solublized in an aqueous medium comprising water and, optionally, solubilizing ingredients such as $C_2$–$C_3$ mono- and di-hydroxy alkanols, e.g., ethanol, isopropanol and propylene glycol, or water soluble salts of $C_1$–$C_3$ alkyl substituted benzene sulfonate hydrotropes, e.g., sodium xylene sulfonate, sodium cumene sulfonate and potassium toluene sulfonate, or mixtures of said $C_2$–$C_3$ alkanols and said $C_1$–$C_3$ substituted benzene sulfonates. Suitable water soluble hydrotropic salts include sodium, potassium, ammonium and mono-, di- and triethanolammonium salts. While the aqueous medium is primarily water, preferably said solubilizing agents are included in order to control the viscosity of the liquid composition and to control low temperature cloud-clear properties. Usually, it is desirable to maintain clarity to a temperature in the range of 5° C. to 10° C. Therefore, the proportion of solubilizer generally will be from about 1%–15%, preferably 2%–12%, most preferably 3%–8%, by weight of the detergent composition with the proportion of ethanol, when present, being 5% by weight or less in order to provide a composition having a flash point above about 46° C. Preferably the solubilizing ingredient will be a mixture of ethanol and either sodium xylene sulfonate or sodium cumene sulfonate or a mixture of said sulfonates.

The foregoing solubilizing ingredients also facilitate the manufacture of the inventive compositions because they tend to inhibit gel formation.

Another preferred optional ingredient in the inventive compositions is a water soluble sodium, potassium or triethanolammonium formate. The formate salts tend to inhibit irreversible gel formation in the final liquid composition when the temperature is reduced to about 5° C. to 8° C. Generally the concentration of the formate will be from 0.5%–6%, preferably 1%–5%, by weight of the nonionic liquid detergent composition.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; preservatives such as formaldehyde or hydrogen peroxide; pearlescing agents and opacifiers; pH modifiers; etc. The proportion of such adjuvant materials, in total, will normally not exceed 15% by weight of the detergent composition, and the percentages of most of such individual components will be a maximum of 5% by weight and preferably less than about 2% by weight.

The present nonionic based light duty liquid detergents such as dishwashing liquids are readily made by simple mixing methods from readily available components which, on storage, do not adversely affect the entire composition. However, it is preferred that the nonionic surfactant be mixed with the solubilizing ingredients, e.g., ethanol and sodium xylene sulfonate, if present, prior to the addition of the water to prevent possible gelation. The nonionic based surfactant system is prepared by sequentially adding with agitation the anionic surfactant, the betaine and ethanolamide to the non-ionic surfactant which has been previously mixed with a solubilizing agent such as ethyl alcohol and/or sodium xylene sulfonate to assist in solubilizing said surfactants, and then adding with agitation the formula amount of water to form an aqueous solution of the nonionic based surfactant system. The high level of fatty acid alkanolamide may cause clouding of the compositions below room temperature, which can be rectified by increasing the level of the sodium xylene sulfate and/or the ethyl alcohol content. The use of mild heating (up to 100° C.) assists in the solubilization of the surfactants. The viscosities are adjustable by changing the total percentage of active ingredients. Usually, no thickening agent is added, but thickeners may be added if higher viscosity liquids are desired. In all such cases the product made will be pourable from a relatively narrow mouth bottle (1.5 cm. diameter) or opening, and the viscosity of the detergent formulation will not be so low as to be like water. The viscosity of the detergent desirably will be at least 100 centipoises (cps) at room temperature, but may be up to about 1,000 centipoises as measured with a Brookfield Viscometer using a number 1 spindle rotating at 12 rpm. Its viscosity may approximate those of commercially acceptable detergents now on the market. The detergent viscosity and the detergent itself remain stable on storage for lengthy periods of time, without color changes or settling out of any insoluble materials. The pH of this formation is substantially neutral, e.g., about 6 to 8 and preferably about 7.5.

These products have unexpectedly desirable properties. For example, the foam quality and detersive property is equal to or better than standard light duty liquid detergents while using a nonionic surfactant as the primary surfactant and minimal amounts of anionic surfactant, thereby achieving a mild, non-irritating liquid detergent.

The mildness property of present nonionic based detergents is clearly shown in Tables 7 and 8, using the in vivo skin irritation test on guinea pigs In the guinea pig test, the abdomen is shaved one day prior to the initiation of the test, an appropriate concentration of the product in water selected from the range of about 0.5%–20% is selected for testing and 1 c.c of the test solution is applied to the two separate areas about one inch square on the shaved abdomen of the test animal. Said area is covered with a patch which is removed after four hours. The foregoing procedure is repeated on the second and third days using different sites on the animal's abdomen. On the sixth day, any hair which has grown is removed with a commercial hair removing product and the test animal is thoroughly rinsed with water and dried. Four hours later each of the test sites is rated by a skilled observer for irritation, i.e., scaling, redness, cracking and visible sores, on a scale of 0–4. A rating of 0 corresponds to no irritation and a rating of 4 indicates visible sores and cracking. The ultimate irritation value represents the average of six ratings. A difference in rating of 0.5 is considered to be significant. The aqueous solutions of detergents utilized in this test contain 5% ethyl alcohol and 7% sodium xylene sulfonate (SXS) in the nonionic based formula and 3% SXS in the anionic based formula.

TABLE 7

| Guinea Pig Dermal Irritation | | |
|---|---|---|
| | Mean Irritation Scores | |
| Sample | 2% | 3% |
| 1. 19/6/4/4.5 Neodol 91-8/ALS/Betaine/LMMEA | 1.3* | 2.2* |
| 2. Commercial LDLD[b] Leading Mildness Brand | 2.9 | 3.8 |

*Significantly different from Leading brand of mild LDLD.

TABLE 8

| Guinea Pig Dermal Irritation | | |
|---|---|---|
| | Mean Irritation Scores | |
| Sample | 2% conc. | 3% conc. |
| 1. 19/6/4/5 N91-8/ALS/Betaine/LMMEA | 2.0 | 2.0** |
| 2. 19/2/4/5 N-91-8/ALS/Betaine/LMMEA | 0.66** | 2.0** |
| 3. Mild Anionic based detergent[14] | 2.0 | 2.8 |

[14]16/6/4/3 AEOS-6.5 EO/ALS/Betaine/LMMEA
**Significantly different from the mild anionic based detergent (14)

The results of this test clearly show that all the nonionic based detergents are significantly less irritating than the commercial brand leading in mildness and the anionic based detergent, with Example 2 (Table 8)containing only 2% anionic surfactant being the least irritating product at 2% concentration.

The following examples are merely illustrative of the invention and are not to be construed as limiting thereof.

| EXAMPLES 1-12 | | | | | | | | | | | | |
|---|---|---|---|---|---|---|---|---|---|---|---|---|
| Ingredient | 1 | 2 | 3 | 4 | 5 | 6 | 7 | 8 | 9 | 10 | 11 | 12 |
| Neodol 91-8 | 19 | 19 | — | — | — | — | — | — | — | — | — | — |
| Neodol 91-6 | — | — | 19 | — | — | — | — | — | — | — | — | — |
| Neodol 23-6.5 | — | — | — | 19 | 16 | — | — | — | — | — | — | — |
| Neodol 25-12 | — | — | — | — | — | 19 | — | — | — | — | — | — |
| Neodol 45-11 | — | — | — | — | — | — | 19 | — | — | — | — | — |
| Tergitol 15-S-9 | — | — | — | — | — | — | — | 19 | — | — | — | — |
| Tergitol 15-S-12 | — | — | — | — | — | — | — | — | 19 | — | — | — |
| Igepal CO-630 | — | — | — | — | — | — | — | — | — | 19 | — | — |
| Plurafac B-26 | — | — | — | — | — | — | — | — | — | — | 19 | — |
| Ultrawet N | — | — | — | — | — | — | — | — | — | — | — | 19 |
| Ammonium lauryl ($C_{12}$-$C_{16}$) sulfate | 6 | 2 | 6 | 6 | 6 | 6 | 6 | 6 | 6 | 6 | 6 | 6 |
| Cocoamido-propyl-dimethyl betaine | 4 | 4 | 4 | 4 | 4 | 4 | 4 | 4 | 4 | 4 | 4 | 4 |
| Lauric/myristic monoetha-nolamide | 5 | 5 | 5 | 5 | 5 | 5 | 5 | 5 | 5 | 5 | 5 | 5 |
| Ethanol | 5 | 5 | 5 | 5 | 5 | 5 | 5 | 5 | 5 | 5 | 5 | 5 |
| Sodium xylene sulfonate | 7 | 7 | 7 | 7 | 7 | 7 | 7 | 7 | 7 | 7 | 7 | 7 |
| Water | Balance | | | | | | | | | | | |

The nonionic surfactant, ethanol and sodium xylene sulfonate are mixed together until homogeneous and clear, at room temperature or at slightly elevated temperatures (a maximum of 100° C.) The ammonium lauryl sulfate, the betaine and the ethanolamide are then added with agitation, followed by the addition of the water, while agitating the mixture to form an aqueous solution of the nonionic based surfactant system. If clouding occurs, additional ethanol and/or sodium xylene sulfonate is added which clarifies the solution immediately.

These nonionic surfactant-based detergent formulations exhibit high foaming properties and are effective in cleaning. Hand dishwashing evaluation indicated that, these formulations are equivalent to or better than two leading dishwashing liquids when used in cleaning dishes soiled with both Crisco shortening and Ragu spaghetti sauce soils as shown in Table 9.

TABLE 9

| | Number of plates washed | |
|---|---|---|
| Composition | Crisco Soil | Ragu Spaghetti Sauce Soil |
| Example 1 | 20 | 41 |
| Example 2 | 17 | 27 |
| Example 3 | 20 | 38 |
| Example 4 | 17 | 32 |
| Example 5 | 16 | 27 |
| Example 6 | 17 | 34 |
| Example 7 | 15 | 32 |
| Example 8 | 16 | 33 |
| Example 9 | 16 | 32 |
| Example 10 | 18 | 37 |
| Example 11 | 17 | 31 |
| Example 12 | 19 | 38 |
| Leading anionic Brand A[a] | 16 | 33 |
| Leading anionic Brand B[b] | 19 | 29 |

Other satisfactory liquid nonionic detergent compositions are set forth in Examples 13-16 which follow, with the composition of Example 13 being a particularly preferred composition.

| EXAMPLE 13 | |
|---|---|
| Composition | % by weight |
| Neodol 91-8 | 19 |
| Ammonium $C_{12}$-$C_{16}$ alkyl sulfate | 6 |
| Cocoamidopropyl dimethyl betaine | 4 |
| Lauric-myristic monoethanolamide | 4 |
| Sodium formate | 2 |
| Sodium xylene sulfonate | 2.4 |
| Sodium cumene sulfonate | 0.5 |
| Ethanol | 1.2 |
| Magnesium sulfate heptahydrate | 1.0 |
| Water, perfume, salts | q.s. |
| | 100.0 |

The composition of Example 13 exhibits a viscosity of 225 cps at 24° C. and has a cloud point below 5° C. and a clear point below 16° C.

When the ethanol and sodium cumene sulfonate are omitted from the composition of Example 13, the viscosity increases to 300 cps at 24° C. On the other hand, when an additional 1% of ethanol is included in the composition of Example 13, the viscosity is reduced to 115 cps.

| EXAMPLES 14-16 | | | |
|---|---|---|---|
| | % by weight | | |
| Composition | 14 | 15 | 16 |
| Neodol 91-8 | 14 | 16 | 8 |
| Ammonium $C_{12}$-$C_{16}$ alkyl sulfate | 2 | 4 | 1 |
| Cocoamidopropyl dimethyl betaine | 2 | 3 | 0.5 |
| Lauric-myristic monoethanol- | 2 | 3 | 0.5 |

-continued

| EXAMPLES 14–16 | | | |
|---|---|---|---|
| | % by weight | | |
| Composition | 14 | 15 | 16 |
| amide | | | |
| Sodium xylene sulfonate | 1.2 | 1.8 | 0.3 |
| Water, salt | q.s | q.s | q.s |
| | 100.0 | 100.0 | 100.0 |

Variations in the above formulations may be made. For example, other anionic surfactants may be substituted for the ammonium lauryl sulfate such as sodium lauryl sulfate, potassium lauryl sulfate, linear dodecyl benzene sulfonate and the like. Similarly, other ethanolamides may be substituted for the lauric/myristic monoethanolamides such as cocomonoethanolamide, cocodiethanolamide, lauric myristic diethanolamide and the like. Likewise, other betaines may be substituted for the cocoamidopropyl betaine such as cocoamidoethylbetaine, cocobetaine and the like.

In addition, the amounts of each of the ingredients may be varied within the parameters set forth herein.

The invention has been described with respect to various examples and embodiments but is not to be limited to these because it is evident that one of skill in the art with the present application before him will be able to utilize substituted and equivalents without departing from the spirit of the invention.

What is claimed is:

1. A high foaming, nonionic surfactant-based, light duty, liquid detergent consisting essentially of, by weight, (A) 13% to 25% of a water soluble nonionic surfactant selected from the group consisting of primary and secondary $C_8$–$C_{18}$ alkanol condensates with 5 to 30 moles of ethylene oxide, condensates of $C_8$–$C_{18}$ alkylphenol with 5to 30 moles of ethylene oxide, condensates of $C_8$–$C_{20}$ alkanol with a heteric mixture of ethylene oxide and propylene oxide having a weight ratio of ethylene oxide to propylene oxide from 2.5:1 to 4:1 and a total alkylene oxide content of 60% to 85% by weight and condensates of 2 to 30 moles of ethylene oxide with sorbitan mono- and tri- $C_{10}$–$C_{20}$ alkanoic acid esters having an HLB of 8 to 15; (B) 2% to 8% of a water-soluble anionic detergent selected from the group consisting of $C_8$–$C_{18}$ alkyl sulfates, $C_8$–$C_{16}$ alkylbenzene sulfonates, $C_{10}$–$C_{20}$ paraffin sulfonates, $C_{10}$–$C_{24}$ alpha olefin sulfonates and $C_8$–$C_{18}$ alkyl sulfosuccinate esters, $C_8$–$C_{18}$ acyl isethionates and $C_8$–$C_{18}$ acyl taurates; (C) 2% to 6% of a water-soluble $C_8$–$C_{18}$ alkyl amidopropyl dimethyl betaine; (D) 2% to 6% of a $C_{12}$–$C_{14}$ fatty acid monoethanolamide foam stabilizer; solubilized in (E) an aqueous medium; the sum of A-D being from 20% to 40% by weight of the composition, said nonionic surfactant being in excess of 50% by weight of said sum and said composition being free of anionic alkyl ether polyethenoxy sulfate detergent.

2. A liquid detergent composition according to claim 1 which includes, in addition, 1% to 15% by weight of a solubilizing agent selected from the group consisting of $C_2$–$C_3$ mono- and di-hydroxy alkanols, water soluble salts of $C_1$–$C_3$ substituted benzene sulfonate hydrotropes and mixtures thereof.

3. A liquid detergent composition according to claim 2 wherein ethanol is present in the amount of 5% by weight or less.

4. A liquid detergent composition according to claim 2 wherein said nonionic surfactant is said condensate of a primary $C_8$–$C_{18}$ alkanol with 5–30 moles of ethylene oxide.

5. A liquid detergent composition according to claim 4 wherein said anionic detergent is selected from the group consisting of $C_{12}$–$C_{16}$ alkyl sulfates, $C_{10}$–$C_{15}$ alkylbenzene sulfonates, $C_{13}$–$C_{17}$ paraffin sulfonates and $C_{12}$–$C_{18}$ alpha olefin sulfonates.

6. A liquid detergent composition according to claim 1 wherein said nonionic surfactant is present in an amount of 16% to 22% by weight, said anionic detergent is present in an amount of 3% to 6% by weight and each of said betaine and said fatty acid alkanolamide are present in an amount of 2% to 6% by weight.

7. A liquid detergent composition according to claim 5 which includes, in addition, 1% to 5% by weight of sodium, potassium or triethanolammonium formate.

8. A liquid detergent composition according to claim 7 wherein said said anionic detergent is a $C_{12}$–$C_{16}$ alkyl sulfate.

9. A method of preparing the liquid detergent of claim 2 which comprises the steps of first mixing said nonionic surfactant with the solubilizing agent, sequentially adding with agitation said anionic surfactant, said betaine and said fatty acid alkanolamide and lastly adding with agitation, the formula amount of water to form an aqueous solution of the nonionic based surfactant composition.

* * * * *